United States Patent [19]

Vogiatzis

[11] 4,071,964

[45] Feb. 7, 1978

[54] FOOTWEAR FASTENING SYSTEM

[76] Inventor: Constantinos Vogiatzis, Flat 1, 92 Lipsett Terrace, Brooklyn Park, S.A. 5032, Australia

[21] Appl. No.: 685,889

[22] Filed: May 12, 1976

[30] Foreign Application Priority Data

June 12, 1975 Australia ..... 13277/76

[51] Int. Cl.[2] ..... A43B 23/00; A43C 7/00

[52] U.S. Cl. ..... 36/50; 24/140; 24/143 R; 24/117

[58] Field of Search ..... 36/50; 24/143 R, 117 R, 24/117 A, 116 A, 141, 140

[56] References Cited

U.S. PATENT DOCUMENTS

| | | | |
|---|---|---|---|
| 1,384,565 | 7/1921 | Martin | 24/141 |
| 1,434,723 | 11/1922 | Triary | 24/140 |
| 1,778,954 | 10/1930 | Mislin | 24/117 R |
| 2,141,801 | 12/1938 | Taft | 24/143 R |
| 2,321,754 | 6/1943 | Koehler | 24/140 |

FOREIGN PATENT DOCUMENTS

| | | | |
|---|---|---|---|
| 1,115,880 | 10/1961 | Germany | 24/143 R |
| 12,516 of | 1900 | United Kingdom | 24/143 R |

*Primary Examiner*—Alfred R. Guest
*Attorney, Agent, or Firm*—Kinzer, Plyer, Dorn & McEachran

[57] ABSTRACT

A footwear fastening system having a lace with spaced knobs or protrusions to engage in shaped holes or eyelets, the holes or eyelets having a slot portion into which the portion of the lace between the knobs or protrusions can be engaged.

5 Claims, 6 Drawing Figures

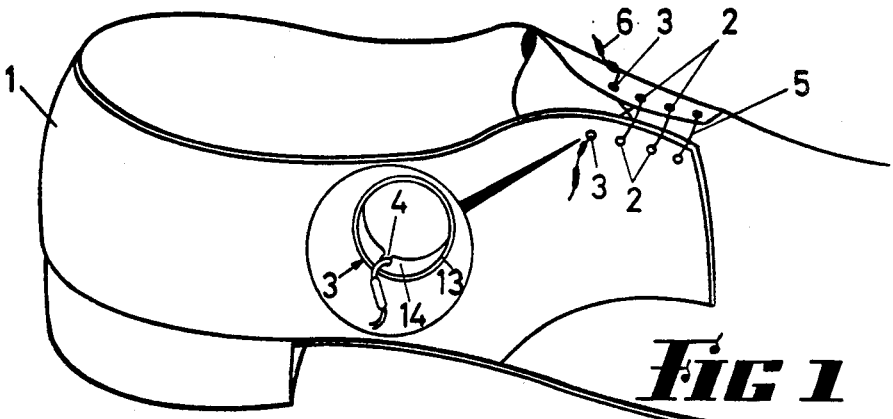
FIG 1
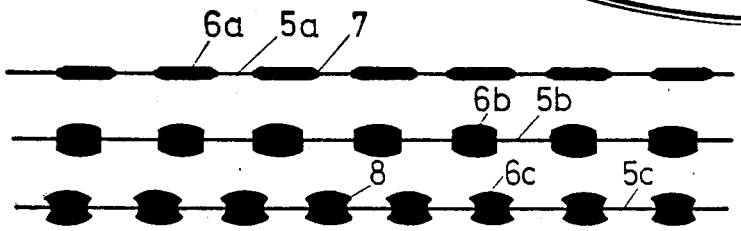
FIG 2
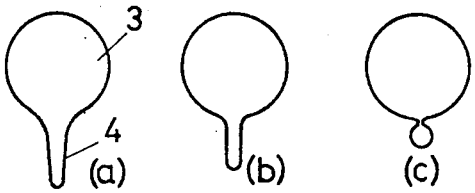
FIG 3
FIG 4
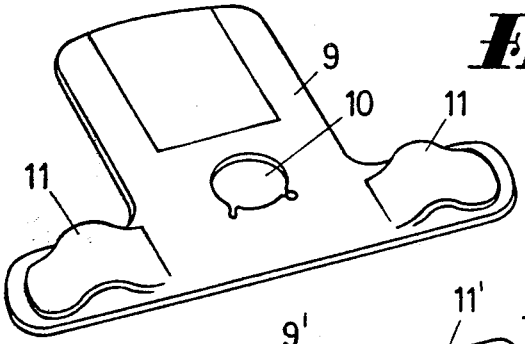
FIG 5
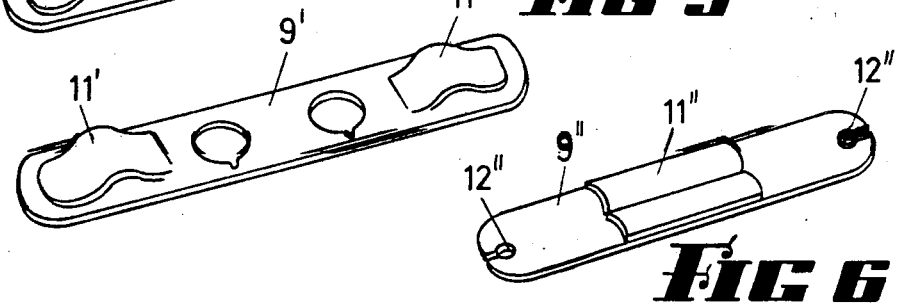
FIG 6

FOOTWEAR FASTENING SYSTEM

This invention relates to a footwear fastening system, and more particularly to a means whereby the lace can be easily and quickly fastened by children to their correct position.

BACKGROUND OF THE INVENTION

Conventionally with children shoelaces are utilised in order to tighten the shoe about the foot and these laces have to be tied in a bow so that the laces can be easily undone. However with children it is very difficult for them to form the correct bow and also to do this with the lace at the correct tension so that the tension in the lace retains the shoe tightly on the foot and also assists in holding the bow and knot in position. Also it is often difficult for elderly people to lace up their shoes due to various reasons and the invention can also be applicable to adult shoes and footwear.

Thus it is an object of this invention to provide a system whereby the laces can be easily secured in position without having to form knots or bows.

SUMMARY OF THE INVENTION

According to this invention the shoe is provided with the usual holes or eyelets for threading the lace therethrough, at least the top eyelet on each side being provided with a radial slot opening into the eyelet hole, with the shoelace being provided either over its whole length or at least at the ends thereof with a series of spaced knobs or protrusions so that the lace in the area between each knob or protrusion can be pulled and then inserted into the radial slot opening into the eyelet. Preferably the radial slot on each eyelet is directed towards each other, and thus be provided a securing flap or hook so that the remaining portion of the lace can be wound or secured so that the long ends of the laces are not hanging loose.

The knobs or protrusions on each lace can be either round, oval, triangular or square or other desired shape, both in a direction longitudinally of the lace and also at right angles to the lace.

As noted above the whole lace could be so formed with these protrusions or the laces can have these formations only at the ends of the lace.

The lace holes or eyelets in the shoe can be of metal or of a suitable plastics material with the slot formed therein, and while the hole in the eyelet may be circular, other shaped holes may be provided such as triangular, square, elliptical or the like to suit the shape of protrusions on the lace.

In an alternate embodiment, the eyelets or holes in the shoe are conventional, and a special piece is provided through which the laces are passed to lock and secure the laces.

The means for securing the loose ends of the lace can comprise a so called spring loaded flap so that the ends of the lace can be engaged in and by pulling on the lace will slip through the spring loading of the flap to be engaged, each lace being wound from one spring loaded flap to the other to thus provide a neat formation of the lace.

BRIEF DESCRIPTION OF THE DRAWINGS

In order to more fully describe the invention reference will now be made to the accompanying drawings in which:

FIG. 1 is a view of a shoe showing one form of the invention,

FIG. 2 is a view showing 3 forms of lace,

FIG. 3 is a view showing 3 forms of locking hole,

FIG. 4 shows an alternative with the locking holes in a separate piece,

FIG. 5 shows an alternate separate piece, and

FIG. 6 shows a further separate piece.

DESCRIPTION OF THE PREFERRED EMBODIMENTS

As shown in FIG. 1, the shoe 1 has the conventional lacing holes 2, while the upper holes 3 are formed in accordance with the invention, these holes being formed with radial slit 4 as later to be described. The lace 5 in this example is over a major portion of its length uniform in diameter, but at its ends is formed with a series of spaced knobs or protrusions 6. This end portion is pulled through the holes 3, and when the desired tension is reached, the lace is pulled radially into the slot 4 to engage a knob 6 on each side of the slot to securely locate the lace 5.

FIG. 2 shows at (*a*), (*b*) and (*c*) three forms of lace 5 which can be utilised. In FIG. 2 (*a*) the lace 5 is a form of metal chain with the lace portions 5*a* being metal wires, and the wires terminating in balls 7 which are enclosed in a sleeve or barrel forming the knobs 6*a*, thus forming a flexible lace.

FIGS. 2(*b*) and 2(*c*) show two forms of lace which are formed of any one of the suitable plastics materials, that shown in FIG. 2(*b*) showing a barrel shaped knob or protrusion 6*b*, these knobs having flat ends and oval or elliptical or curved sides. FIG. 2(*c*) however shows a preferred form where the knobs 6*c* are formed again of a plastics material. However these have a protruding flange 8 at each end, these flanges 8 being resilient and thus when in use a flange 8 on knob 6*c* engages around the slit 4 and resiliently exerts a pressure thereon, so that once inserted in position under tension the flange will slightly deform to resiliently maintain this tension, and so greatly assist in maintaining the lace in the secured position.

As shown in FIGS. 3(*a*), (*b*) and (*c*) the holes 3 can have the slits formed in various shapes, either tapered, parallel, or in a latching or releasable manner as in FIG. 3(*c*). In that illustration the slit has a constriction through which the lace must pass to assist in maintaining the lace in its secured position.

The holes 3 can be formed in the shoe or the footwear itself, and usually the upper pair of holes only would be so formed, so that the lace can be located therein. Also the lace can have the knobs over its whole length, but preferably are provided at the ends only.

In order however that the invention can readily be applied to shoes not having a specially formed hole or eyelet, the separate piece 9 can be provided. This is positioned on the shoe after lacing the shoe, the laces passing through the hole 10 with two separate slits 4, and the laces hooked into the slits 4. The piece 9 then sets on top of the opening of the shoe, and can have a pair of securing members 11 so that the ends of the laces can be secured. These members 11 are spring loaded so that the laces can be slipped thereunder and secured. The separate piece 9 could be of any desired shape and have a pocket or the like to receive a novelty item if desired.

As shown in FIG. 5 the piece 9' is of smaller configuration and can include two holes 3', one for each lace, and also a clamp 11' to hold the laces.

FIG. 6 shows a further alternative with the holes 12' at the ends of the piece 9', these holes being smaller than knob 6, and being connected to the outside edge by slits 4 through which the lace 5 can pass to locate a knob 6 in the hole 12" without passing through the hole 12". A suitable clamp 12" can also be provided to hold the laces. It is preferred that this piece have its holes 12" spaced apart a greater distance than the holes of the shoe so that the tension and the laces tends to hold the laces in the holes 12", and to minimise the chances of the lace passing out of the slit 4. The holes 12" can be holes completely passing through the piece 9" or can alternatively be a form of countersunk hole in which the knobs would securely rest.

As shown in FIG. 1 the eyelet 3 can be formed with a circular outer rim 13, so that it is inserted into a shoe in conventional manner. However the eyelet 3 does not have a circular hole, but has a small infill portion 14 having the slit 4 therein this infill portion 14 merging into the curvature of the circular eyelet 3. In order to have the infill portion 14 and still allow sufficient clearance for the protrusions on the lace to be pulled through the eyelet, the eyelet may be formed of larger size than conventional eyelets. However the eyelet would be applied to the shoe in conventional manner.

The lace itself between the protrusion may be a lace of one of the plastics materials, or can be a string, cotton, or fibre lace coated in a sheath of plastics material, or even the lace can be a metal wire with a sheath of plastics material.

It is to be realized that by the invention the lace may be the protrusions or knobs towards the ends thereof, or may be formed over the whole length with such knobs or protrusions. Also the holes or eyelets on the shoe may only have the last pair of holes formed with the slit to accommodate the lace, but with certain types of shoes which require to be laced tightly over the whole length, or even with boots where the lacing may pass right up to the top of the boot, which may be required for various purposes such as medical reasons, all the holes may be so formed or selected holes may be formed in order to assist in maintaining the tension in the lace.

Also it is realised that the lace may have the protrusions of various shapes and configuration and also that the lace may be fastened by the separate fastening piece which can sit on top of the shoe, and can readily be formed of a material such as plastic or leather in various colours and can be made as a decorative part of the shoe.

The pieces 9 as shown in FIGS. 4, 5 or 6 while they are illustrated as being flat, can preferably be flexible so that they conform to the shape of the shoe. Alternatively these pieces can be moulded or shaped to the shoe shape and also have some degree of flexibility to assist in forming a neat fit to the shoe.

Also the laces, where the laces are sheathed either in plastic, fabric, or the like, that the base material of the lace is formed with the knobs or protrusions and the sheathing covers these protrusions also so that the sheathing material does not slip or shift relative to the base material.

I claim:

1. A shoe or similar footwear having holes for a lace to fasten the shoe, the lace having over at least the end portions thereof spaced knobs or protrusions adapted to engage in shaped holes or eyelets carried by the footwear to receive the lace with the knobs or protrusions preventing the lace moving through the hole, characterized in that each protrusion on the lace has a resilient lip surrounding that portion of the lace connecting each protrusion, whereby the lip engages around the hole so that the lace is resiliently held even though the tension of the lace varies during flexing of the shoe.

2. Footwear as defined in claim 1 in combination with the separate element having the shaped holes therein, the separate element overlying at least the upper portion of the lacing portion of the shoe, whereby the tension of the lace threaded through the holes retains the element in position due to the resilient lip on the protrusions.

3. A shoe as defined in claim 2 wherein the separate piece also has retaining means to hold and retain the ends of the lace.

4. A shoe or similar footwear as defined in claim 2 wherein the separate piece is flexible to conform to the shape of the shoe.

5. A shoe or similar footwear as defined in claim 1 wherein the lace can be a flexible material such as string, cord, wire or one of the plastics materials, the lace is desired being sheathed over the protrusions with a sheathing material such as a plastic material or fabric.

* * * * *